US010780341B2

(12) United States Patent
Cao

(10) Patent No.: US 10,780,341 B2
(45) Date of Patent: Sep. 22, 2020

(54) SPACE MAZE PUZZLE WITH RECONFIGURABLE PATHS

(71) Applicant: Yang Cao, East Meadow, NY (US)

(72) Inventor: Yang Cao, East Meadow, NY (US)

( * ) Notice: Subject to any disclaimer, the term of this patent is extended or adjusted under 35 U.S.C. 154(b) by 0 days.

(21) Appl. No.: 16/544,306

(22) Filed: Aug. 19, 2019

(65) Prior Publication Data

US 2020/0054937 A1 Feb. 20, 2020

Related U.S. Application Data

(60) Provisional application No. 62/719,633, filed on Aug. 18, 2018.

(51) Int. Cl.
*A63F 7/04* (2006.01)
*A63F 7/30* (2006.01)

(52) U.S. Cl.
CPC ..... *A63F 7/042* (2013.01); *A63F 7/047* (2013.01); *A63F 7/30* (2013.01); *A63F 2007/3035* (2013.01)

(58) Field of Classification Search
CPC .. A63F 7/042; A63F 7/30; A63F 7/047; A63F 2007/3035; A63F 9/0078; A63F 9/0857; A63F 7/044; A63F 9/0826; A63F 9/0383
See application file for complete search history.

(56) References Cited

U.S. PATENT DOCUMENTS 426,569 A * 4/1890 O'Shaughnessy .... A63F 9/0078 273/153 R
479,475 A * 7/1892 Stutz ..... A63F 7/044 273/109
2,509,340 A * 5/1950 Fly ..... A63F 7/042 273/109
4,452,455 A 6/1984 Bergstrom et al.
4,484,744 A * 11/1984 Gmunder ..... A63F 9/0857 273/153 S (Continued)

FOREIGN PATENT DOCUMENTS

DE 3246974 A1 * 6/1984 ..... A63F 9/0857
FR 2511884 A1 * 3/1983 ..... A63F 9/0857
FR 2522518 A1 * 9/1983 ..... A63F 9/0857

OTHER PUBLICATIONS

International Search Report for PCT/US2019/047043.

(Continued)

*Primary Examiner* — Steven B Wong
(74) *Attorney, Agent, or Firm* — Yong Chen

(57) ABSTRACT

A space puzzle including a plurality of outer face panels, at least two of the plurality of outer face panels each defining at least one path segment. Each of the outer face panels is rotatable, and the rotation of any one of the outer face panels is independent of and not altering any path segment defined in another of the outer face panels. The path segments on the at least two of the outer face panels of the puzzle are configured such that at least one sequence of rotations of at least one of the at least two of the outer face panels exists that permits a position indicator to travel along a continuous pathway between a preset starting point and a preset finish point along the at least one path segment of the at least two of the plurality of outer face panels.

12 Claims, 18 Drawing Sheets

(56) References Cited

U.S. PATENT DOCUMENTS 4,526,372 A * 7/1985 Kikis ..... A63F 9/0857 273/153 S
4,553,754 A * 11/1985 Wiggs ..... A63F 9/0857 273/153 S
4,754,972 A 7/1988 Boskovic
4,805,910 A * 2/1989 Monticolombi ..... A63F 9/0078 273/153 R
4,872,682 A * 10/1989 Kuchimanchi ..... A63F 9/083 273/153 S
5,816,571 A * 10/1998 Chen ..... A63F 9/0857 273/153 S
5,823,530 A * 10/1998 Yang ..... A63F 9/0865 273/153 S
6,241,248 B1 * 6/2001 Winter ..... A63F 9/12 273/153 S
8,387,984 B2 * 3/2013 Artsiely ..... A63F 9/0857 273/153 S
8,807,566 B2 * 8/2014 Zagyvai ..... A63H 33/00 273/156
10,245,504 B2 * 4/2019 Yang ..... A63F 9/0842
2005/0164758 A1 * 7/2005 Boeru ..... A63F 3/00094 463/9
2006/0226600 A1 * 10/2006 Fang ..... A63F 7/042 273/153 S
2010/0276881 A1 * 11/2010 Tu ..... A63F 7/042 273/241
2014/0077454 A1 * 3/2014 Lapstun ..... A63F 13/005 273/153 S
2014/0306404 A1 10/2014 Encina Cusi
2016/0346676 A1 * 12/2016 Houlis ..... A63F 9/088
2019/0358549 A1 * 11/2019 Osipov ..... A63F 13/92

OTHER PUBLICATIONS

"Art Egg"—cited in International Search Report for PCT/US2019/047043 (retrieved from webarchive https://theartegg.com).
"Transreality puzzle as new genres of entertainment technology" (OSIPOV) 2017—cited in International Search Report for PCT/US2019/047043 (retrieved from internet at https://arxiv.org/ftp/arxiv/papers/1705/1705.03973.pdf).

* cited by examiner

SPACE MAZE PUZZLE WITH RECONFIGURABLE PATHS

CROSS REFERENCE TO RELATED APPLICATION

This application claims the benefit of priority of U.S. Provisional Application 62/719,633, filed Aug. 18, 2019, the disclosure of which is incorporated herein by reference in its entirety.

TECHNICAL FIELD

The present disclosure relates to a three-dimensional maze puzzle. More particularly, the present disclosure relates to the design and construction of a toy maze puzzle, where the paths of the maze puzzle are reconfigurable through rotations of the face panels of the toy.

BACKGROUND

Original mazes are built with real walls that leave passage between walls, and the player finds solutions of the mazes by traveling through a continuous route or pathway from an entry point to an exit point along available passages. Usually, at many junctures along the passages, the player has more than one choice. If the player chooses the wrong passage, he or she will encounter a dead end and has to retrace to the previous juncture to explore other paths. The games of mazes were later implemented on paper or playing board, for example, the "walls" or barriers can be represented by solid lines and the "passages" represented by the space between the solid lines. The player can solve such mazes simply by drawing a continuous line between the entry point and the exit point, or moving a small object along the passages. Such mazes can also be easily implemented on a computer, and a player can solve the mazes by indicating the solution by drawing the path using a pointing device. Conceptually, these mazes are two-dimensional in nature.

New generations of toys and games are built by combining a plurality of 2D mazes in a 3D object. For example, multiple layers of 2D mazes can be included in an enclosure, and a mechanism of inter-layer crossing can be accomplished by including holes on the 2D mazes or tunnels/channels between the 2D mazes. There are also 3D mazes where passages may extend in different spatial directions. For example, cubic toy products are available with each face of the cube including a fixed maze pattern, and passages at the edges and/or corners of the cube can span different faces so that a small object can be manipulated to travel across these different faces to reach a finish point.

There are 3D puzzles that challenge players primarily with maneuvering skills rather than solution-finding insights. For example. Perplexus® line of product is a 3-D ball-in-a-maze puzzle or labyrinth game enclosed in a transparent plastic sphere, where the player manipulates a small ball through a track by twisting and turning the sphere as a whole. The path to the finish point can be quite apparent to the player, but to actually maneuver the ball through the track to get to the finish point can be challenging because the segments of the track can be configured with many difficulty levels (e.g., varying width, visibility, friction, stability, and obstacles), and one mishap in the manipulation can result in the ball getting derailed from the track.

SUMMARY OF THE INVENTION

In one aspect, the present disclosure provides a space puzzle which comprises a plurality of outer face panels (or outer faces). At least two of the plurality of outer face panels each define at least one path segment. A position indicator can be coupled to and movable along the at least one path segment of each of the at least two of the plurality of outer face panels. Each of the outer face panels is rotatable, and the rotation of any one of the outer face panels is independent of and not altering any path segment defined in another of the outer face panels. The path segments on the outer face panels of the puzzle are configured such that at least one sequence of rotations of the outer face panels exists that permits the position indicator to travel along a continuous pathway between a preset starting point and a preset finish point along the path segments of the at least two of the plurality of outer face panels.

In some embodiments of the space puzzle, the at least one path segment is defined by a cut-out slit on the outer face panel where the at least one path segment is located. In some embodiments, the at least one path segment is defined by an element, a property, or a characteristic that is visually distinct from the remainder of the outer face panel where the at least one path segment is located.

In some embodiments, the space puzzle further comprises a puzzle core to which the plurality of outer face panels are engaged. The puzzle core can comprise a plurality of blocks fitted together, or a plurality of face pieces fitted together. In other embodiments, the puzzle core can comprise a plurality of rods/tubes that can be coupled to corresponding coupling structure (e.g., tubes/rods) on the outer face panels.

In some embodiments, the outer face panels of the puzzle can be coupled to the puzzle core via corresponding fixation panels. In some other embodiments, outer face panels can be coupled directly to the puzzle core.

In some embodiments, the outer face panels can comprise a paramagnetic material or magnetic material.

In some embodiments, each of the outer face panels has a same number of sides. In other embodiments, not all of the outer faces have the same number of sides.

In some embodiments, each of the outer face panels a periphery that takes the shape of a convex regular polygon.

In some embodiments, each of the outer face panels includes a digital touchscreen.

In some embodiments, the at least one path segment can be defined by a visual digital marker.

In another aspect, the present disclosure provides a space puzzle, which includes a plurality of outer face panels, where at least two of the plurality of outer face panels each define at least one path segment. Each of the outer face panels is rotatable, and the rotation of any one of the outer face panels is independent of and not altering any path segment defined in another of the outer face panels. The path segments on the at least two of the outer face panels of the puzzle are configured such that at least one sequence of rotations of at least one of the at least two of the outer face panels exists that permits a position indicator travel along a continuous pathway between a preset starting point and a preset finish point along the at least one path segment of the at least two of the plurality of outer face panels.

DETAILED DESCRIPTION

The present disclosure provides a 3D space maze toy having reconfigurable and dynamic paths by manipulations of outer faces of the toy. Solving the maze not only requires a player to be cognizant of the path patterns on each outer face of the toy, but also requires the player to take into account of connections of the path patterns in the 3-dimensional space as well as the time-evolution of the patterns. Therefore, the toy of the present disclosure presents enhanced challenges for a player's problem solving skills as well as enhanced intrigue.

Figure 1A:
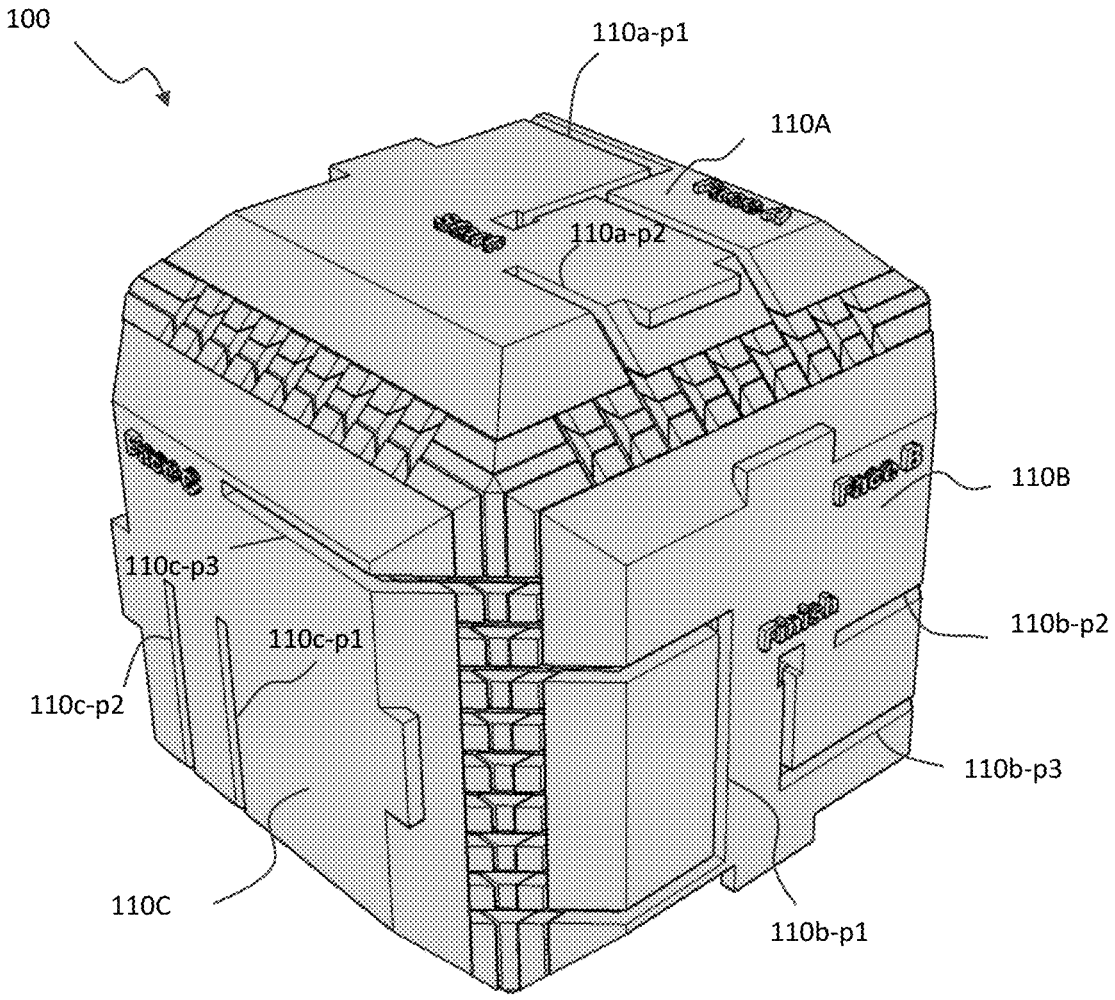
FIG. 1A schematically depicts a space puzzle (toy puzzle) according to some embodiments of the present invention.

As illustrated in FIG. 1A, a space puzzle 100 of the present disclosure comprises a plurality of outer face panels 110A (top), 110B (right), 110C (front), each of the outer face panels having an outer periphery of a shape of a regular polygon. In FIG. 1A, the space puzzle 100 takes an overall shape of a cube, where the polygon for each face panel is a square (having 4 sides or edges). For at least two of the outer face panels, each face panel includes at least one path (or passage) segment along which a position indicator (or mover piece) can move. For example, as shown in FIG. 1A, outer face panel 110A has two path segments: 110*a*-p1 and 110*a*-p2; outer face panel 110B has three path segments: 110*b*-*p*1, 110*b*-*p*2, and 110*b*-*p*3; outer face panel 110C has three path segments: 110*c*-*p*1, 110*c*-*p*2, 110*c*-*p*3.

The path segment or segments in each of the outer face panels may take various shapes, and may not cross over. Also, the path segments can have different configurations. As shown in FIG. 1A, the path segments can be generally cut-out slits on the outer face panels. Other configurations of the path segments are also suitable. For example, the path segment(s) can be defined by a maker line, a groove, a depression, an embossing, a channel sandwiched in walls or marker lines, etc., that are visually distinct from the remainder of the outer face panel and suitable for the corresponding position indicator to couple to and move along.

Figure 1B:
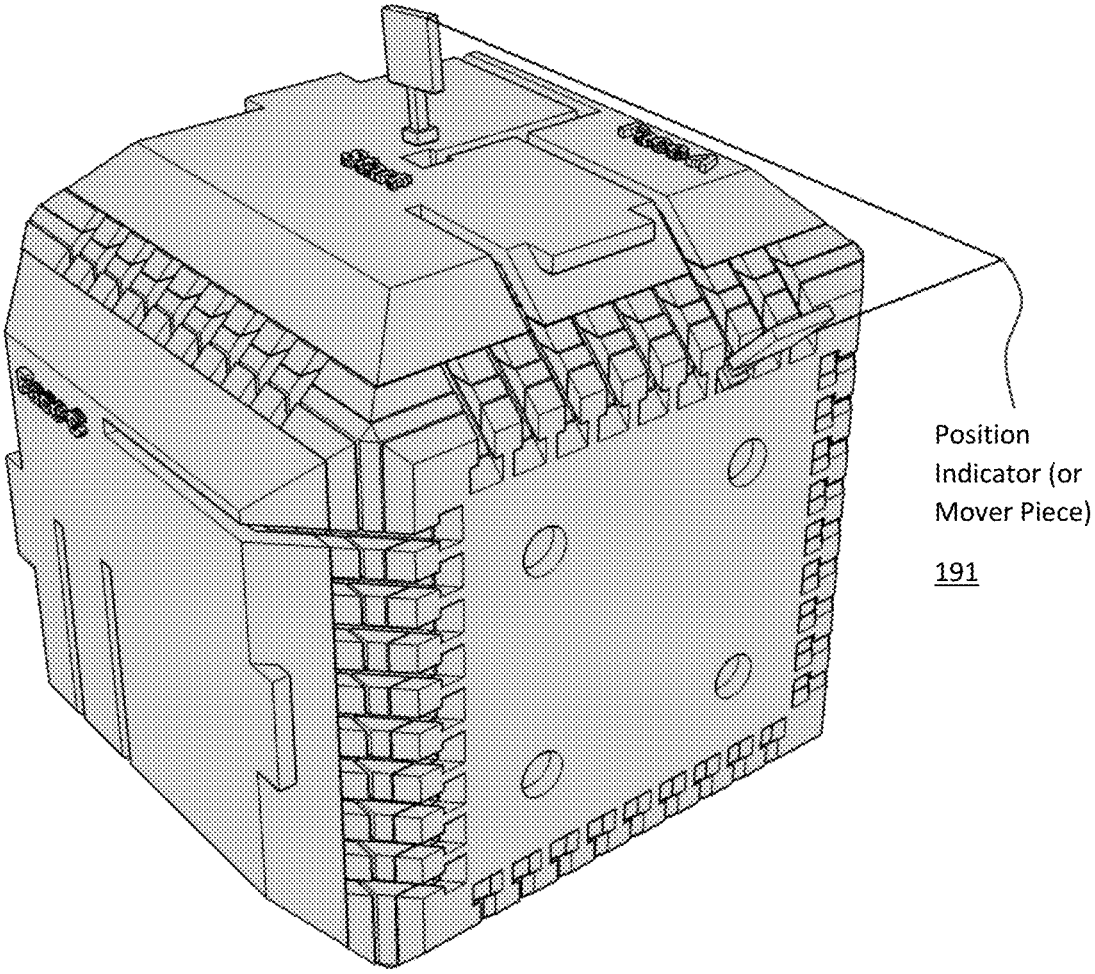
FIG. 1B schematically depicts a space puzzle, including a position indicator which can be coupled to the path segments of outer face panels of the space puzzle, according to some embodiments of the present invention.

The position indicator can be a solid object configured to be coupled to and movable along the path segment(s). As shown in FIG. 1B, in an embodiment, the position indicator 191 (shown in two different possible positions) has a shape having an enlarged bottom and enlarged head portion, and a "waist" portion therebetween, such that it can be physically coupled with the slit with the waist portion, with the exposed head portion protruding out from the path segment to facilitate manual handling. Note that in FIG. 1B, face panel 110B shown in FIG. 1A has been removed, exposing a fixation panel underneath as will be further described below.

Figure 2:
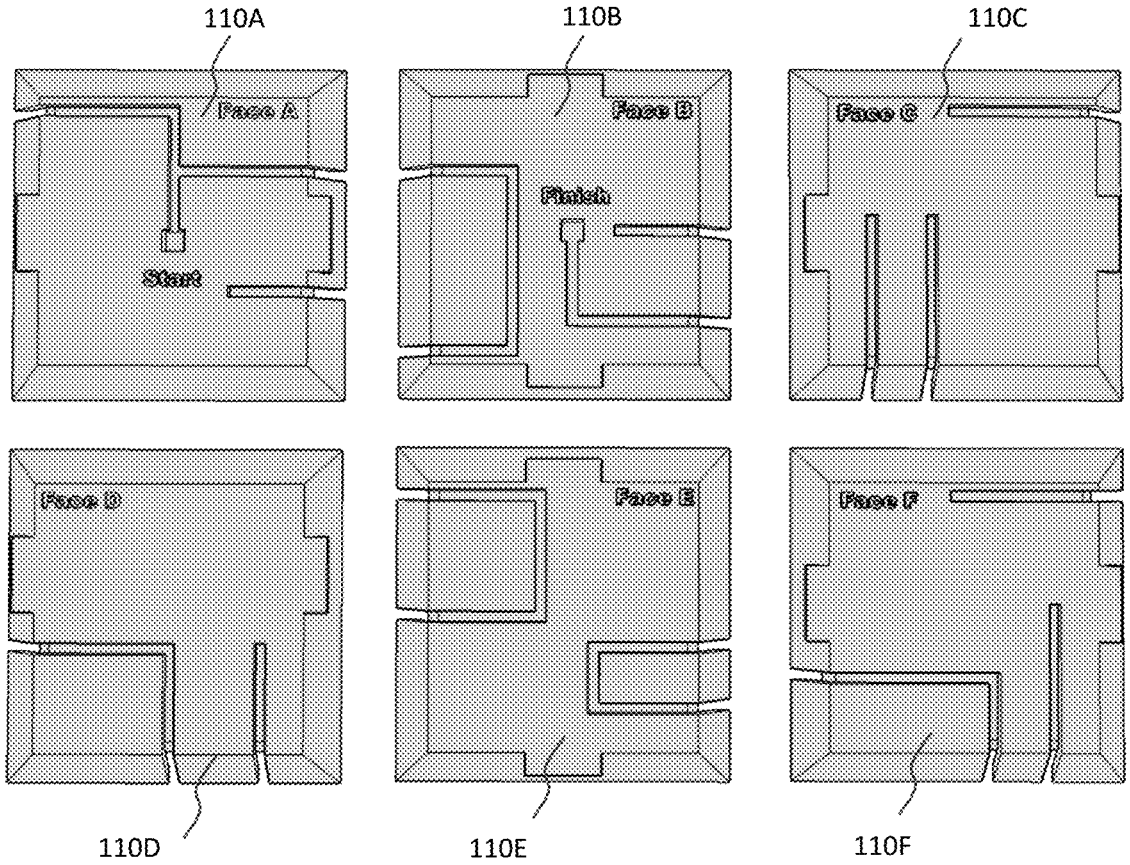
FIG. 2 shows path segment patterns for 6 outer face panels of the space puzzle shown in FIG. 1.

FIG. 2 shows the path segment patterns for each of the 6 outer face panels of the cube toy shown in FIG. 1 (outer face panels 110D, 110E, 110F in the order of left/back/bottom were not shown in FIG. 1 as they are hidden from view).

Figure 3A:
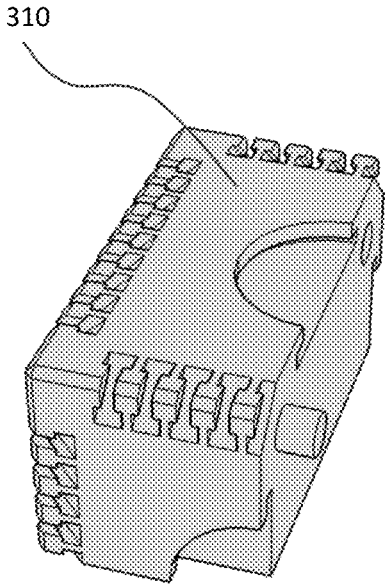
FIGS. 3A and 3B show a basic building block 310 for a part of the core of a space puzzle according to some embodiments of the present invention from different angles.
Figure 3B:
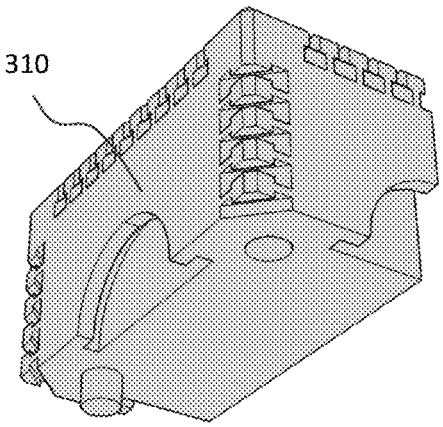
Figure 4A:
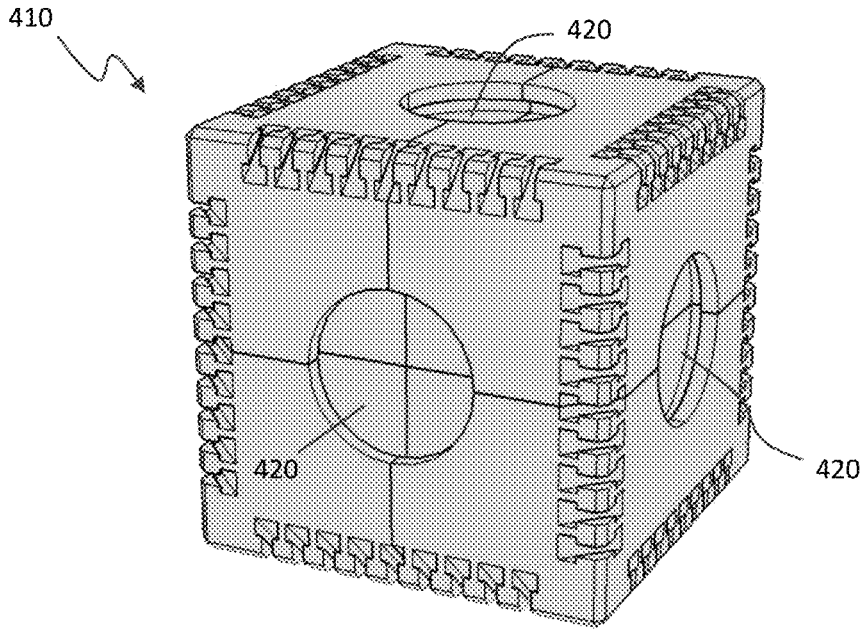
FIG. 4A shows an assembled core of a space puzzle according to some embodiments of the present invention.
Figure 4B:
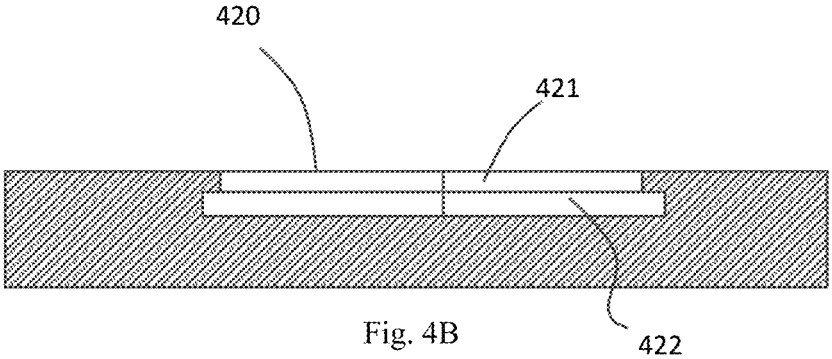
FIG. 4B shows a cross-sectional view of a central circular void of the assembled core.

There are many ways to construct and/or assemble a toy puzzle of the present disclosure. The toy puzzle shown in FIG. 1 can be assembled in a way with reference to FIGS. 3-7. FIGS. 3A and 3B show a basic building block 310 for a part of the core of the toy puzzle. Four pieces of building block 310 can be assembled together to form the core 410 shown in FIG. 4A, with each face having a central circular void 420 having a stepped configuration including a first/top section 421 and a second/bottom section 422 having a greater diameter, as shown in the cross-sectional view FIG. 4B.

Figure 5A:
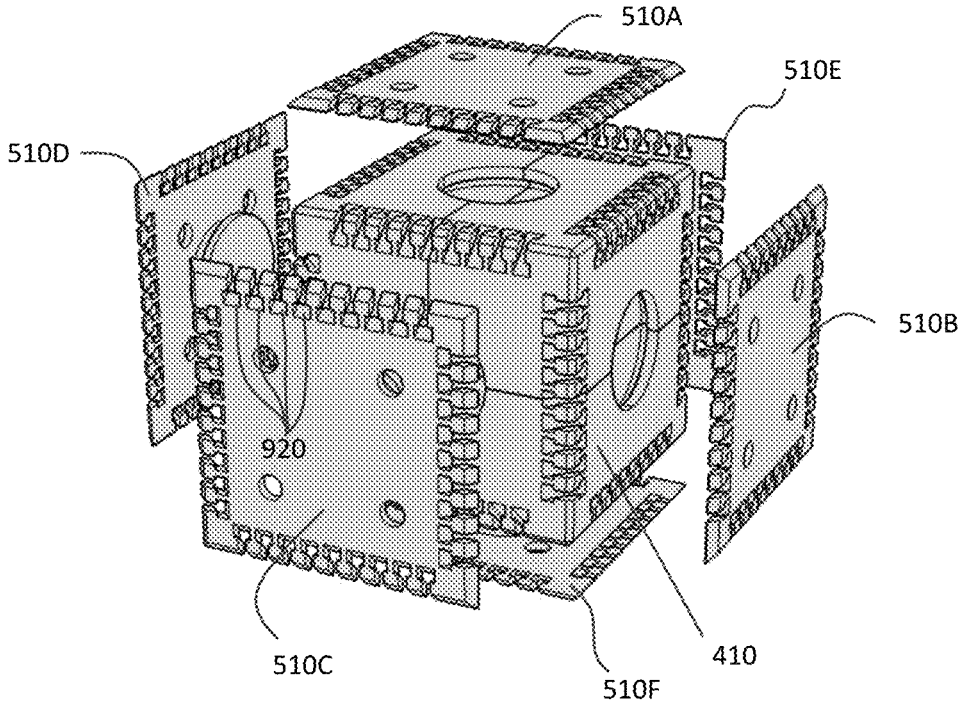
FIGS. 5A-5D show an example process of assembling six fixation panels onto the core of a space puzzle according to some embodiments of the present invention.
Figure 5B:
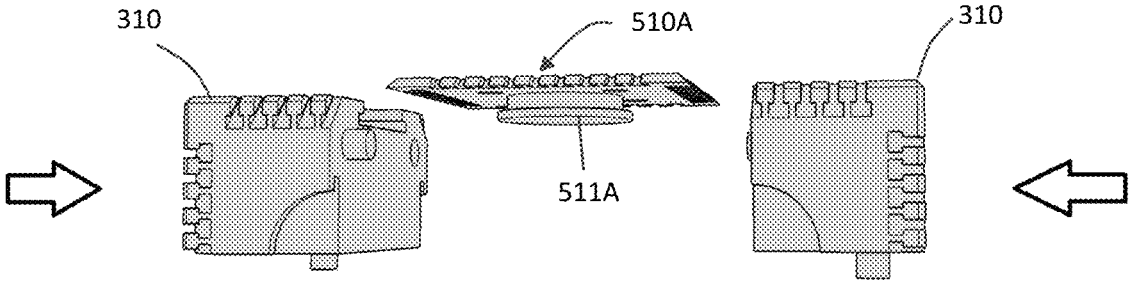
Figure 5C:
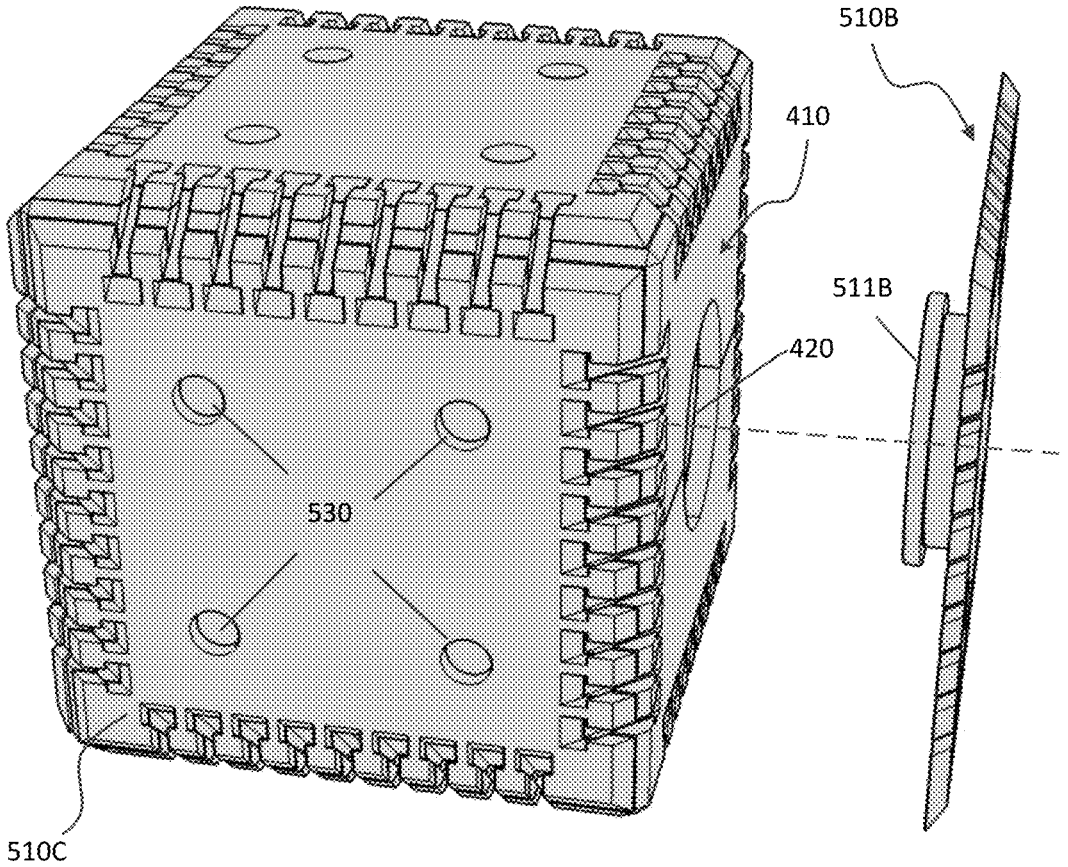
Figure 5D:
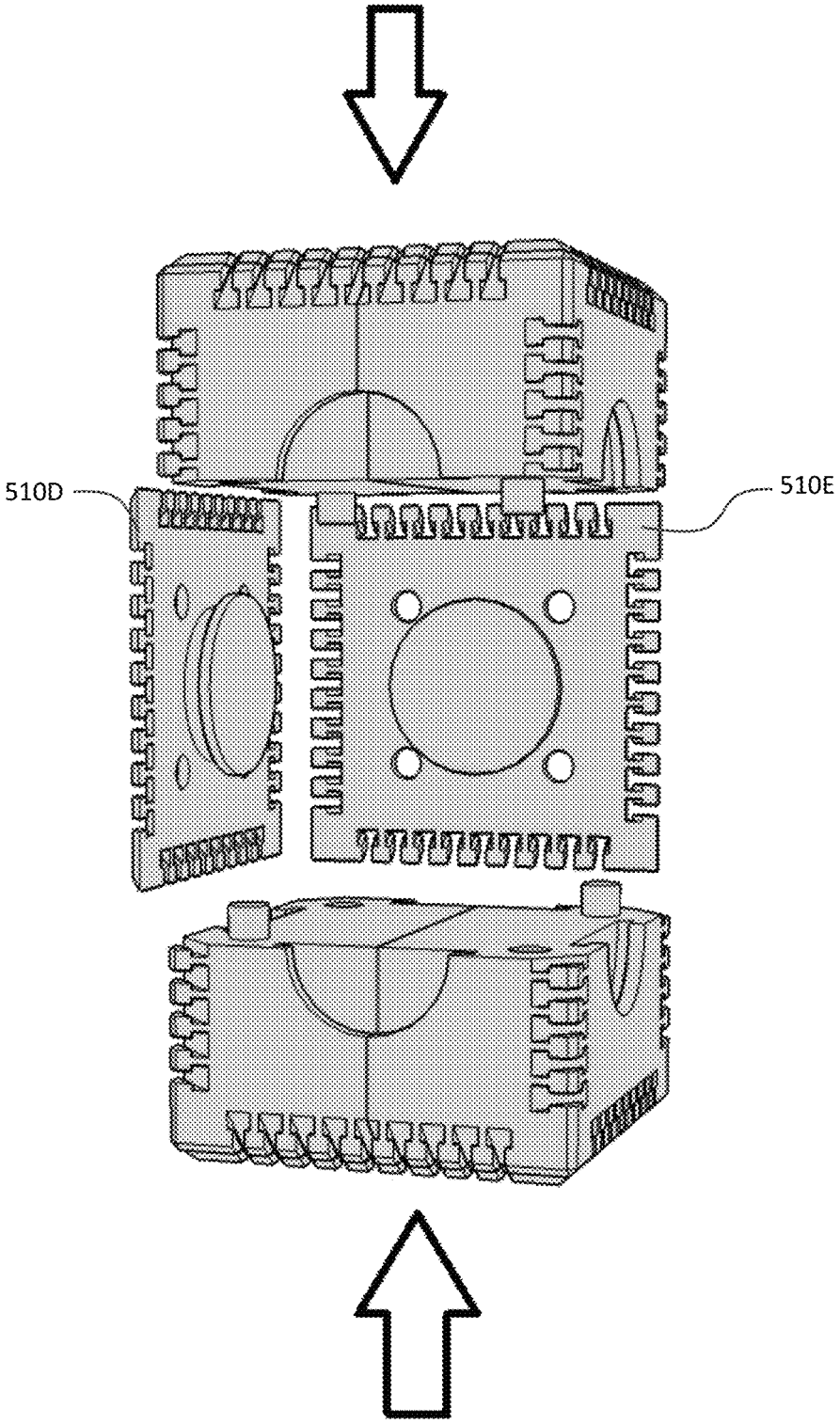

Then, as shown in FIG. 5A, six fixation panels 510A, 510B, 510C, 510D, 510E and 510F are each assembled onto the assembled core 410. This is accomplished by inserting a portion of each of the fixation panels into a respective circular void of a corresponding face of the core 410, as illustrated in FIGS. 5B, 5C and 5D. As illustrated in FIGS. 5B-5D, fixation panel 510A (510B) includes a central circular stage 511A (511B) having a stepped configuration complementary to that of the circular void 420 on the core 410. Likewise, fixation panels 510C and 510D also include central circular stages. Thus, the fixational panels can be assembled with the core 410 by positioning the circular stages of the fixation panels between the building blocks of the core 410, such that after the building blocks of the core 410 are coupled together (as shown in FIG. 5D), the voids 420 and the circular stages of the fixation panels form a mating coupling between the core 410 and the fixation panels. Due to the circular configuration of both the void 420*s* and the circular central stages of the fixation panels, each of the fixation panels can be rotated freely along a direction along the coupling axis (i.e., normal to the panel plane).

Figure 6A:
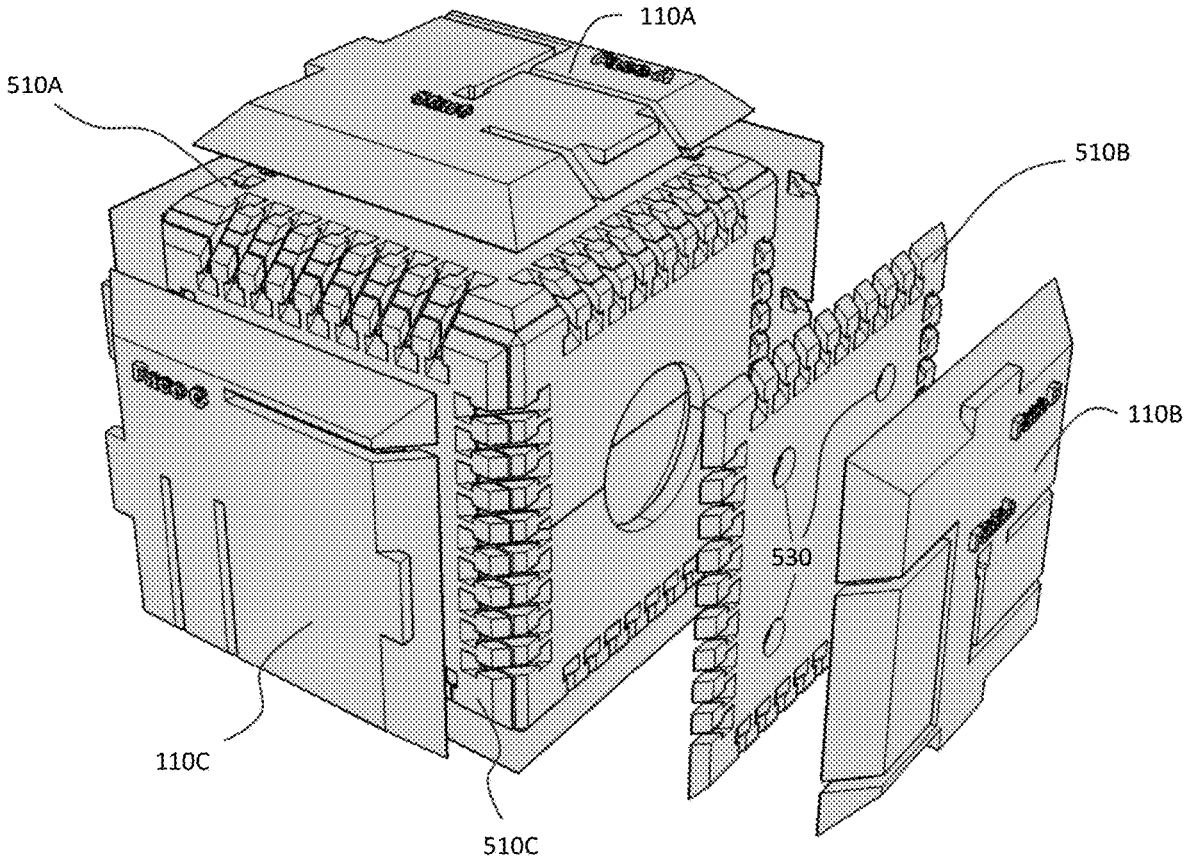
FIGS. 6A and 6B show how outer face panels can be fitted onto the fixation panels previously assembled onto the core of a space puzzle according to some embodiments of the present invention.
Figure 6B:
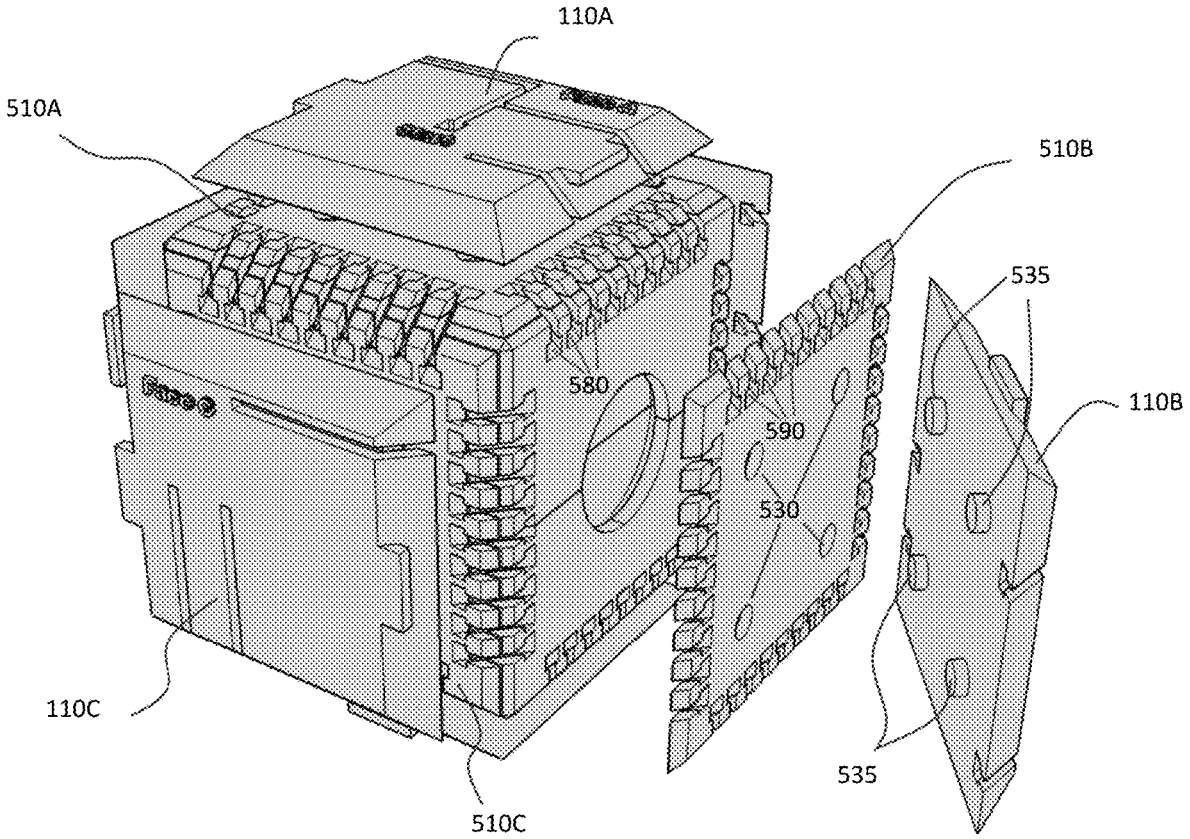

As further illustrated in FIG. 6A, outer face panels 110A, 110B, and 110C are each installed on a respective fixation panel via coupling to surface cavities 530 shown in FIG. 5C. As shown in FIG. 6B, the inner side of outer face panel 110B includes four protrusions 535 which are dimensioned and configured to engage with the surface cavities 530, whereby the outer face panel 110B can be assembled onto the fixation panel 510B.

In the above illustrations, the respective outer face panels are separate structures from the corresponding fixation panels and can be assembled with the corresponding fixation panels, it is appreciated that each outer face panel and the matching fixation panel could also be permanently joined or manufactured as one integral part.

Figure 7A:
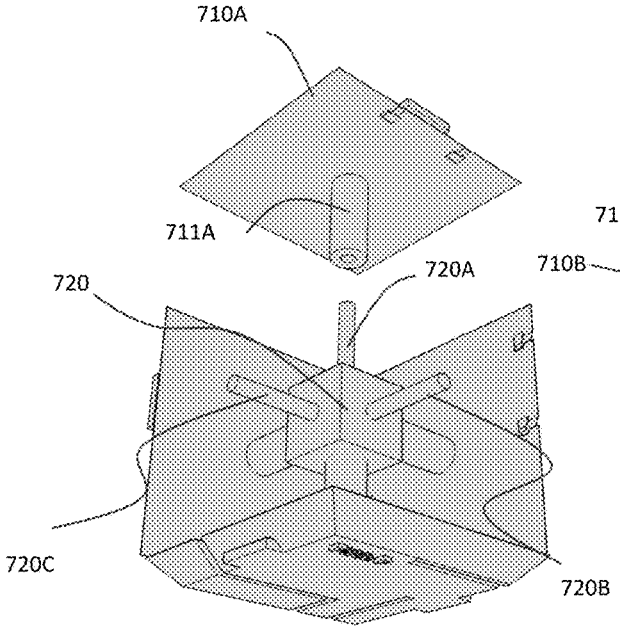
FIGS. 7A and 7B show an alternative construction of a space puzzle according to some embodiments of the present invention.
Figure 7B:
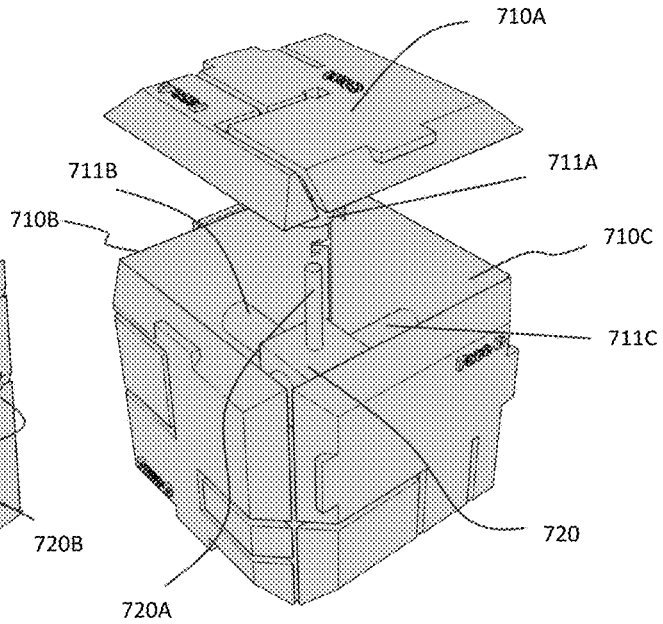

In some embodiments of the space puzzle, the puzzle core can be constructed differently, and no fixation panels are needed. For example, as shown in FIGS. 7A and 7B, the outer face panels 710A, 710B, 710C can each have a connecting cylindrical tube (711A, 711B, 711C) extending from the interior side of the panel, whose other end couples with a center body (or core) 720 with a plurality of cylindrical connecting rods 720A, 720B, 720C. In this manner, each of the outer face panels can rotate along the respective cylindrical connecting rod, and the path segments in the face panels will also be rotated.

In the described embodiments of the space puzzle of the present disclosure, the rotation of any one of the outer face panels is independent of and not altering any path segment defined in another of the outer face panels.

In a traditional two-dimensional maze game, a player tries to find a pathway from a preset entry point to a preset exit point. The objective of the puzzle game of the toy puzzle of the present disclosure is similarly to find a pathway from a preset starting point on one outer face panel to a preset finish point on the same or a different outer face panel. However, because of the 3-dimensional nature of the toy puzzle and the rotatability of each of the outer panels, the toy puzzle of the present disclosure enables a game having more levels of complexity. As such, the design of the path segments on the outer face panels of the puzzle are configured such that at least one sequence of rotations of the outer face panels exists that permits the position indicator to travel from a continuous path (or pathway) between a preset starting point and a preset finish point along the path segments of the at least two of the plurality of outer face panels.

As illustrated in FIGS. 1-7 and with reference to a cube toy puzzle of the present disclosure, each path segment in each outer face panels shown has at least one entry (or exit) point on the edge/side of the respective outer face panels, by which the path segment may "cross over" to or "connect with" a path segment on an adjacent outer face panel to thereby form a continuous expanded path spanning the two adjacent outer face panels when the two adjacent outer face panels are appropriately oriented. To facilitate a mover piece to cross from one outer face panel to another, the edges of the fixation panels as well as the core of the toy can be provided with a number of crossing bridges or tunnels on the edges (as shown in the various drawings, e.g., FIG. 6B in which the bridges 580 on the core and bridges 590 on a fixation panel are labeled). The bridges may have a configuration, e.g., cut-out with a specific cross section that provides a mating coupling with the mover piece, which allows the mover piece to smoothly slide out from a path segment of a first outer face panel, cross the bridge, and slide into a path segment of an adjacent outer face panel without disengaging from the space puzzle. In these illustrations, the outer panels are slightly smaller than the corresponding fixation panels and the fixation panels are slightly smaller than the corresponding faces of the core, such that the path segments on the outer panels, the bridges on the fixation panels, and the bridges on the core can form continuous path for the mover piece to navigate through. In other constructions of the puzzle, the bridges may not be necessary.

Figure 8A:
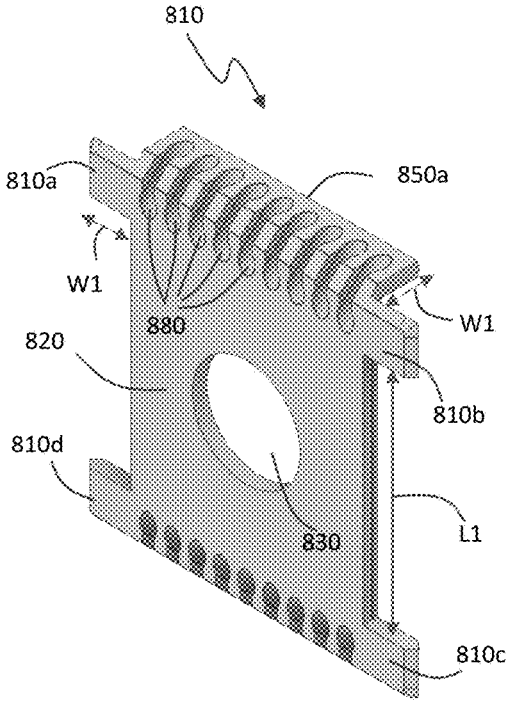
FIG. 8A depicts the structure of a core face piece which can be used to construct a space puzzle core according to some embodiments of the present invention.
Figure 8B:
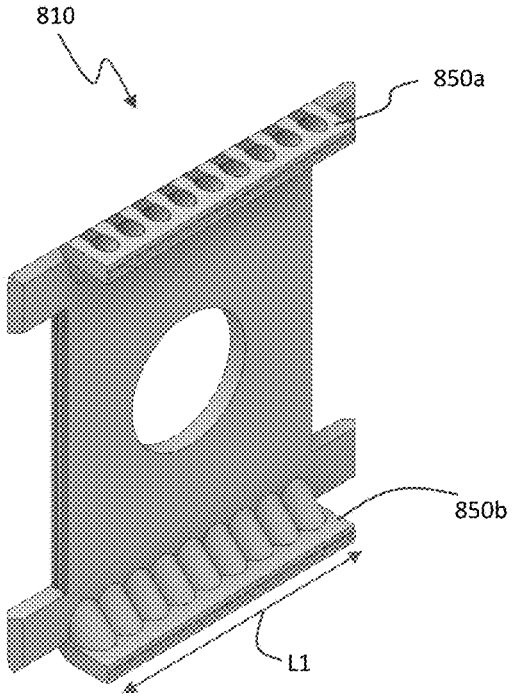
FIG. 8B shows the core face piece of FIG. 8A from a different angle.
Figure 8C:
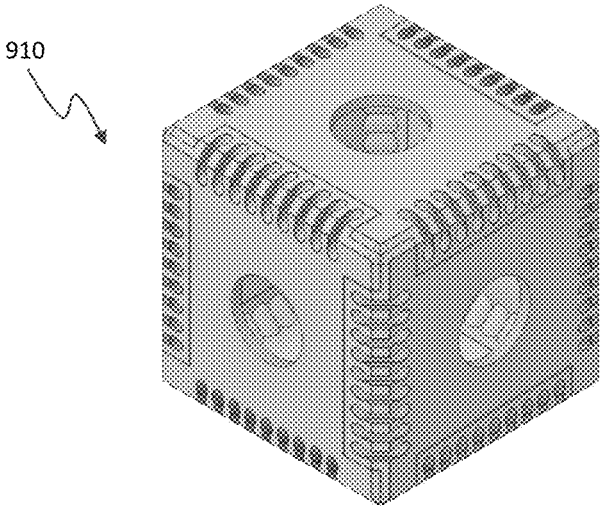
FIG. 8C shows a space puzzle core constructed by 6 core face pieces shown in FIG. 8A (or FIG. 8B).

As illustrated in FIGS. 8A-8C, the core of a cubic toy puzzle 910 of the present invention can be constructed by 6 identical core face piece 810. Each core face piece 810 includes a planar portion 820, and two identical-dimensioned opposing edge portion 850*a* and 850*b* each bent 90 degrees from the planar portion 820 and extending out from the planar portion for a width of W1. 9 parallel bridges 880 are arranged approximate each of the two tab portions 850*a*/850*b*, each bridge including an entry/exit point from the planar portion 820 and exit/entry point on the bent tab portions 850*a*/850*b*. In addition, each of the core face piece 810 includes four identical-dimensioned protruding tabs 810*a*, 810*b*, 810*c* and 810*d* on the planar portion 820, where the tabs 810*a* and 810*b* are opposite to each other and each extending from the edge approximate the first tab portion 850*a* for the distance of W1, and the tabs 810*c* and 810*d* each extending along the edge approximate the second tab portion 850*b* for the distance of W1. When 6 core face pieces 810 are assembled, the edge portion 850*a* of each core face piece (having a length of L1) is fitted in the gap between the two protruding tabs 810*b*/810*c* (having the length of L1), and the edge portion 850*b* of each core face piece (having the length of L1) is fitted in the gap between two protruding tabs 810*a*/810*d* of another adjacent core face piece (having a length of L1). In such a manner, a cubic puzzle core can be constructed. The core face pieces may be joined to each other simply by friction, or they may be joined to each other by adhesive, heat welding, or others techniques known in the art, depending on the materials of construction.

As shown in FIGS. 8A-8C, the center of the core face piece 810 can include a circular void 830. This can allow the fitting with a central circular coupling stage/knob or a similar coupling mechanism (e.g., as depicted in FIGS. 5B-5D) of an outer face panel (or a fixation panel on which an outer face panel is to be installed). The coupling stage can be made of a flexible material or a reversibly collapsible/expandable construction to allow insertion of the coupling stage after the puzzle core is assembled.

Figure 8D:
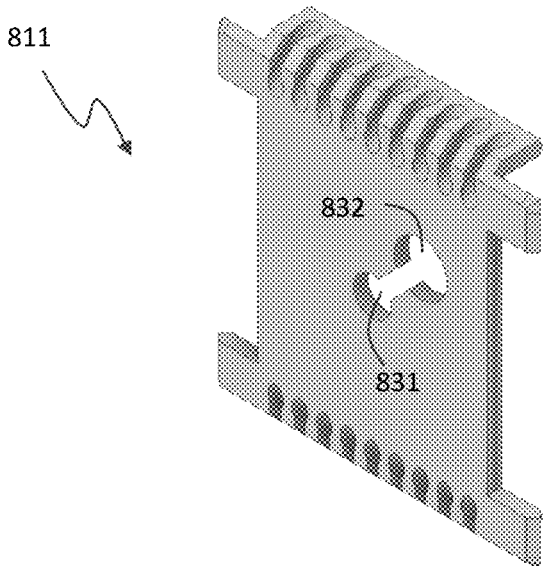
FIG. 8D depicts the structure of an alternative core face piece which can be used to construct the core of a space puzzle according to some embodiments of the present invention.
Figure 8E:
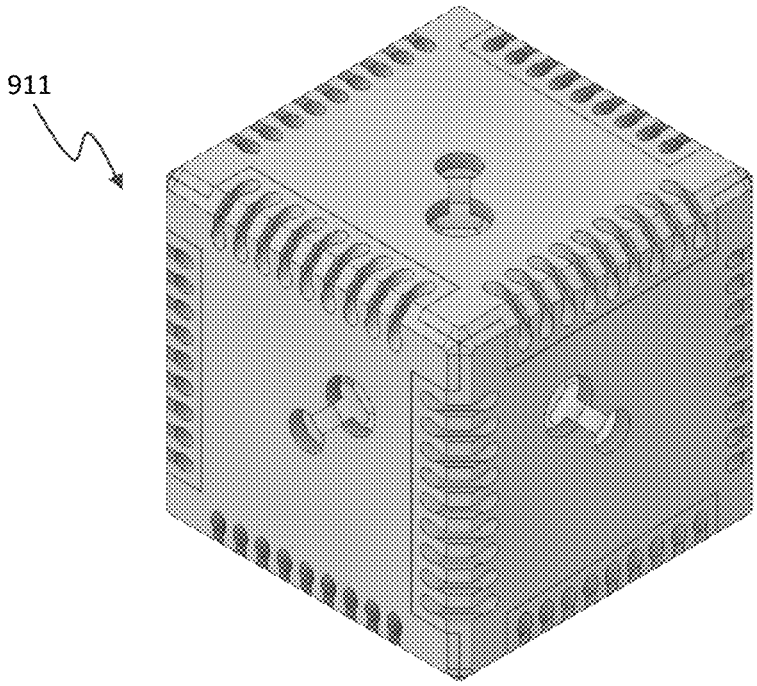
FIG. 8E shows a space puzzle core constructed by 6 core face pieces shown in FIG. 8D.

In alternative embodiments, the core face pieces of the shown in FIGS. 8A-8C can have different shaped central voids, such as those shown in FIGS. 8D and 8E, where each face piece 811 of the core 911 includes a dumbbell-shaped void that includes a central circular void 831 and a second, off-center circular void that is connected with the central circular void 831 via a "channel" which has a width smaller than the diameter of each of the void 831 and the void 832. This configuration allows easy insertion of a circular coupling stage/knob or a similar coupling mechanism (e.g., as depicted in FIGS. 5B-5D) of an outer face panel (or a fixation panel on which an outer face panel is to be installed) through the larger void 832 and sliding of the circular coupling stage to the smaller void 831 as the destination, at which location the coupling is stabilized and future handling/rotation of the outer face panel is to be performed.

Figure 9A:
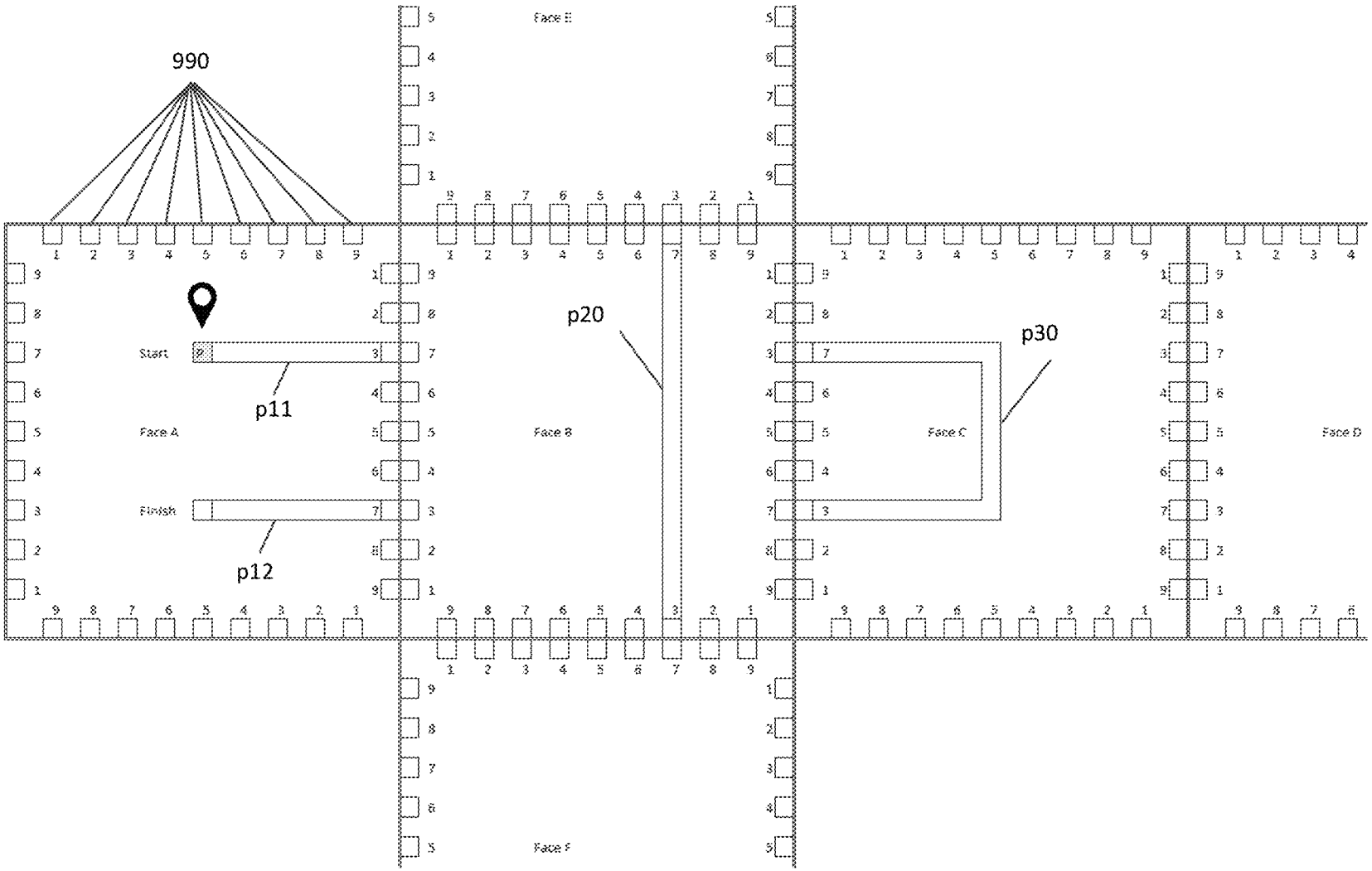
FIG. 9A shows a 2D representation of an example space puzzle of the present invention (the 6 faces of the space puzzle have been "flattened" to better show features on each face) in an initial state.
Figure 9B:
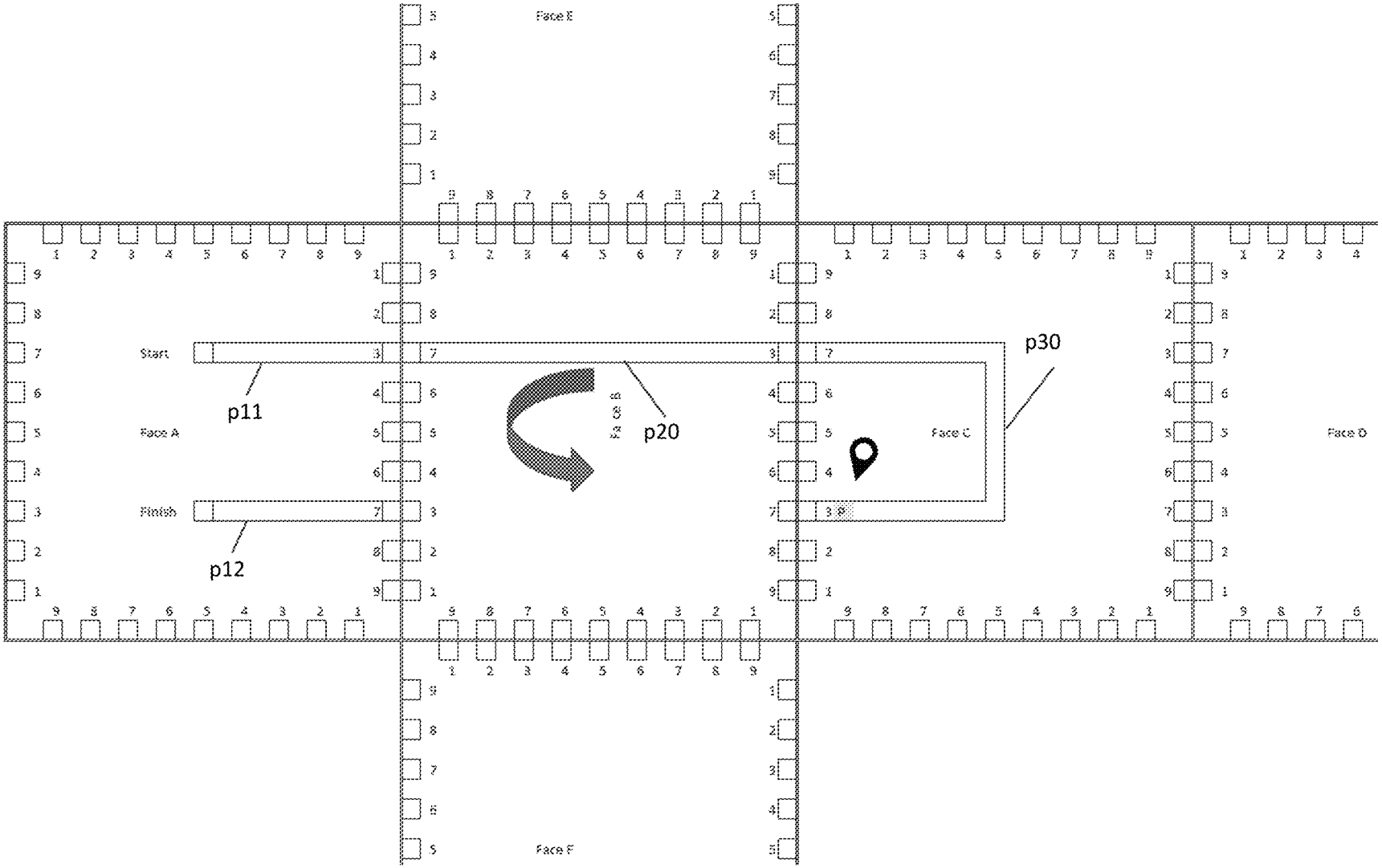
FIG. 9B depicts the example space puzzle after Face B has been rotated counterclockwise for 90 degrees from the initial state shown in FIG. 9A.
Figure 9C:
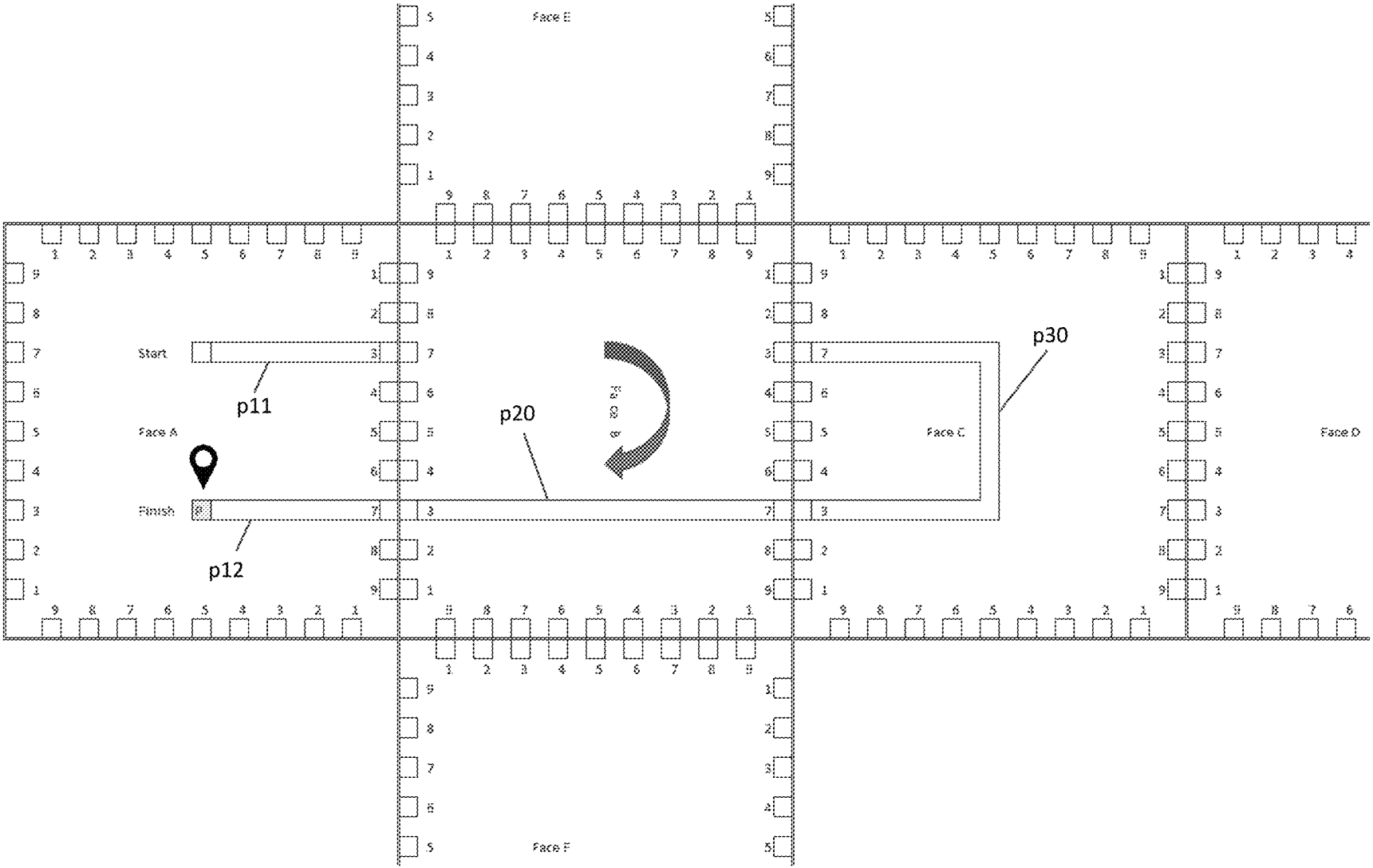
FIG. 9C depicts the example space puzzle after Face B has been rotated for 180 degrees from the state shown in FIG. 9B.
Figure 10:
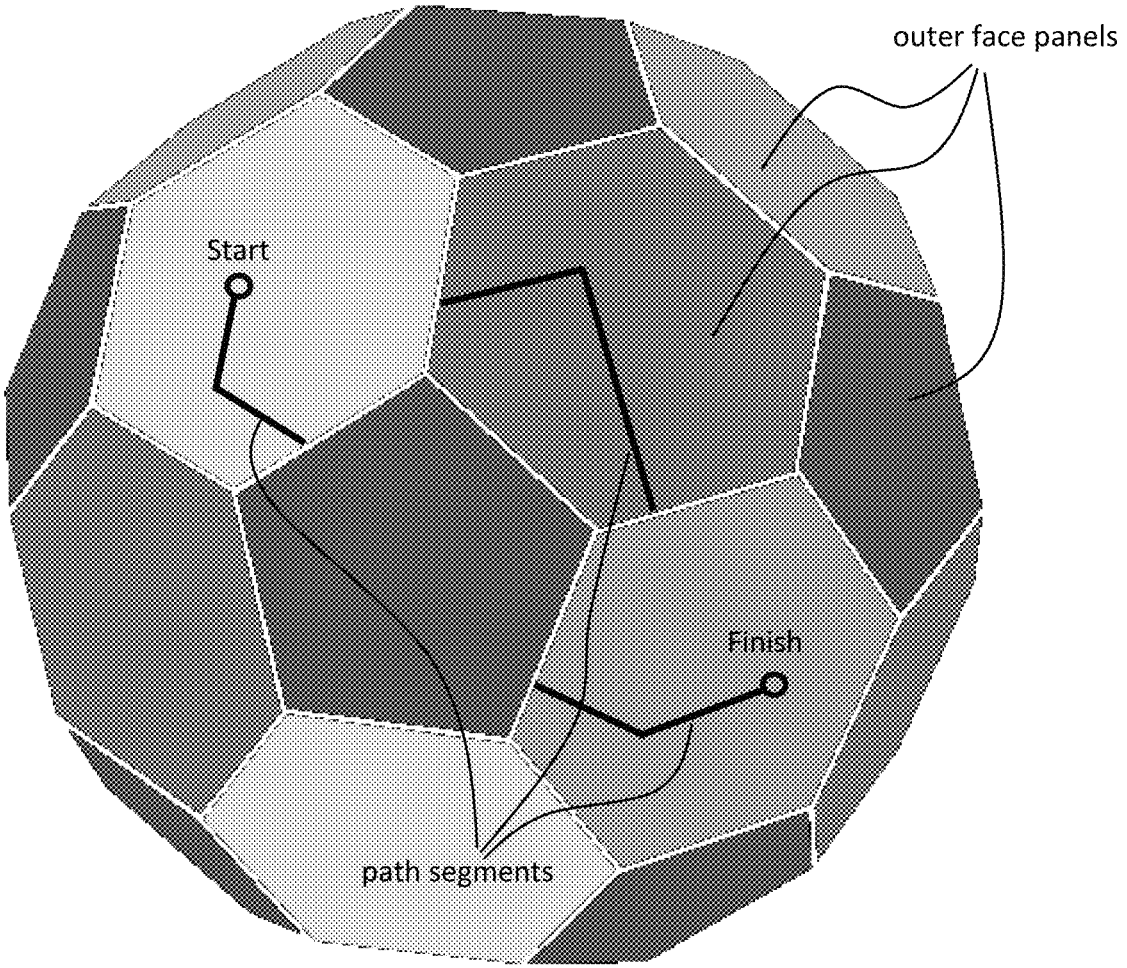
FIG. 10 shows a space puzzle where not all of the outer face panels have the same number of sides.
Figure 11:
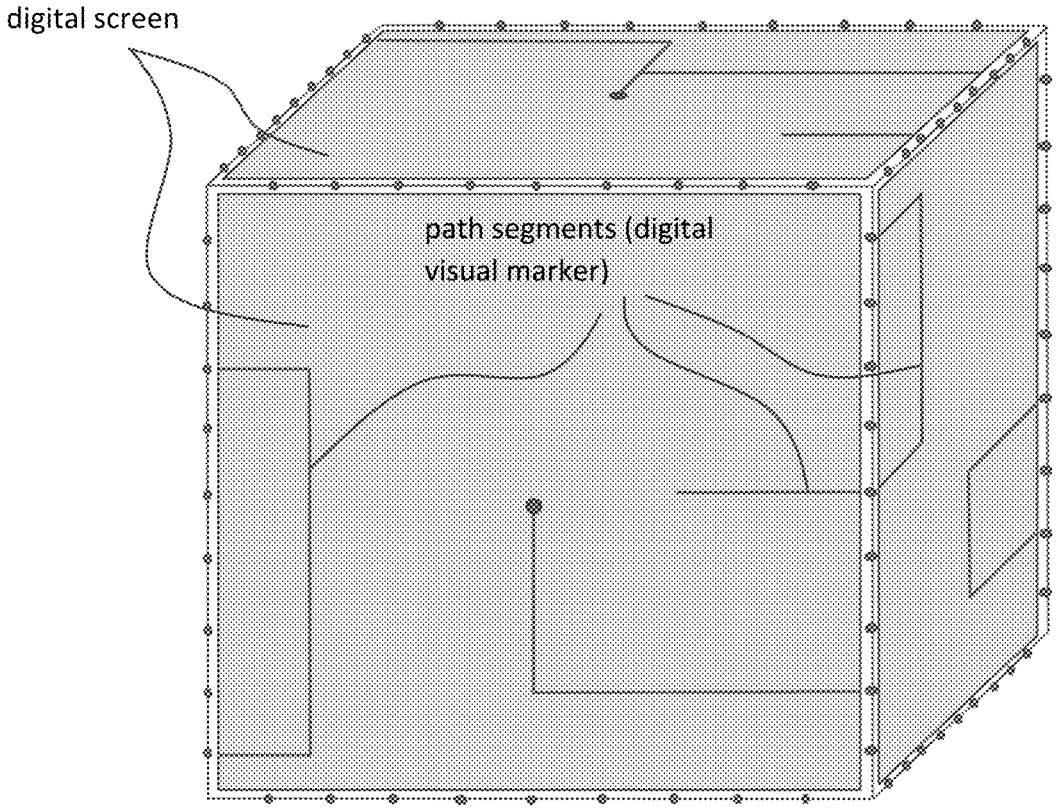
FIG. 11 shows a space puzzle with outer face panels including digital touchscreens, in which path segments are defined by visual digital markers.

FIGS. 9A-9C schematically show an example cube puzzle that has been "flattened" where the 6 faces (i.e., Face A, Face B, Face C, Face D, Face E, and Face F) are shown on a 2D space. Each face shown can be considered a combination of an outer face panel with the underlying fixation panel. Each face has 4 sides or edges, and each edge has 9 bridges (990) that allow the mover piece to go through to move to an adjacent face. These bridges on each edge are numbered clockwise from 1 to 9. Each face can be rotated as previously noted. Since each face is adjacent to other four faces, each edge on any particular face has the chance to meet 16 different edges in each step by rotating one or more adjacent faces. When the path segment on one face connects to a path segment on another face and the numbers on both paths add up to 10, the mover piece can then be moved from one face to the other.

In FIGS. 9A-9C, for a simplified illustration, only three faces contain path segments (p11 and p12 on Face A; p20 on Face B; and p30 on Face C) and are used to present a solvable puzzle solution. The mover piece "P" is at the Start position in FIG. 9A. To solve this particular puzzle, a player can perform the following:

(1) rotate Face B counterclockwise once (i.e., for 90 degrees), then the mover piece "P" can be moved from Face A through path segment p11, through bridge number 3 to Face B bridge number 7 (3+7=10), through path segment p20 on Face B, then through Face B bridge number 3 to Face C bridge number 7 (3+7=10), through path segment p30 on Face C, and finally it can stop at Face C bridge number 3 (See FIG. 9B).

(2) rotate Face B clockwise twice (i.e., for 180 degrees), then the mover piece "P" can be moved from Face C bridge number 3 to Face B bridge number 7 (3+7=10), through path segment p20 on Face B, then through Face B bridge number 3 to Face A bridge number 7 (3+7=10), then through path segment p20 on Face A, and finally it can be moved to the Finish position on Face A (See FIG. 9C).

One way to design the path or passage pattern on the faces of the cube puzzle toy can be as follows. On each face, one can choose to include different number of bridges, and can choose which bridges can be connected in the path. For a size 9 puzzle (9 bridges on each edge), there are more than 100,000 possible path patterns to choose from for each face. The six faces then will have more than $10^{30}$ path pattern combinations in total, and each of these $10^{30}$ combinations is a maze design. A computer program can be written to innumerate all possible maze designs. For each of the $10^{30}$ designs, the program can go through all the possible rotations by a trial and error approach to determine whether a successful path connecting the starting position and the finish position exists. Then the program can record all the successful designs along with the solutions and store them in a database. Finally, one can select a maze design from the database based on the preferred difficulty. Other ways to design the path patterns are also available.

In some embodiments, the outer face panels of the toy puzzle of the present disclosure can be polygons. In some embodiments, all of the outer face panels can be of the same class of polygons. For example, the space puzzle can take an overall shape of one of the convex regular polyhedral, known as the Platonic Solids, which include tetrahedron (4 outer faces of equilateral triangles), cube (6 outer faces of squares), octahedron (8 outer faces of equilateral triangles), dodecahedron (12 outer faces of equilateral pentagons); and icosahedron (20 outer faces of equilateral triangles). In some embodiments, not all the outer face panels are of the same class of polygons. For example, the space puzzle can take an overall shape of a truncated icosahedron when all the faces are aligned. Such a solid geometry has 12 regular pentagonal faces and 20 regular hexagonal faces. For another example, the space puzzle can take an overall shape of a truncated tetrahedron, which has 4 regular hexagonal faces and 4 equilateral triangle faces.

The material for constructing components of the space puzzle of the present invention can be plastic, metal, wood, or any other suitable material, or combinations thereof. Various components of the space puzzle can be manufactured by injection molding, 3D printing, or other suitable techniques.

The mover piece can be constructed in various ways in shapes and materials. For example, the mover piece may be constructed with a magnetic material, and the outer face panels are constructed with a material (e.g., a paramagnetic material) that is attractive to such a magnetic material, the mover piece can be simply attached on the surface of the outer face panels by magnetic forces. Or the mover piece may be constructed with or include a paramagnetic material and the outer face panels are constructed with or include a magnetic material.

The path segments on the outer face panels can also be constructed in various ways. In some embodiments, the outer face panels may be constructed by digital screens (e.g., LCD, LED, OLED, or the like) and the path segments may be formed by display units showing different color or shade than the remainder of the screen as effectuated by input control electronic signals. In such cases, the rotation of the outer face panels can also be accomplished in a virtual manner, i.e., the outer face panels are not actually physically rotated, but the pattern of the path segments on the outer face panels can be rotated by input control signals. This may be done by an operating method available to a digital touchscreen, e.g., a multi-finger gesture right on the face panels of the toy. The construction of the other parts of this "digital" toy, including the processor, memory, input/output module is within the skills of artisan in the field. In such cases, the mover piece can also be a digital object on the touchscreens movable and manipulatable by touching the touchscreens, e.g., by a human finger or a digital pen.

In some embodiments, the toy puzzle does not need to include a mover piece. In such cases, one can simply use one's eyes to track an "imaginary mover piece" moving on the available path segments on the face panels.

While the example embodiments of the invention have been set forth for the purpose of illustration, modifications of these embodiments as well as other embodiments thereof may occur to those skilled in the art. Accordingly, the appended claims are intended to cover all embodiments, which do not depart from the spirit and scope of the invention.

The invention claimed is:

1. A space puzzle, comprising:

a plurality of outer face panels, at least two of the plurality of outer face panels each defining at least one path segment;

a position indicator configured to be coupled to and movable along the at least one path segment of each of the at least two of the plurality of outer face panels;

wherein each of the outer face panels has a periphery that takes the shape of a convex regular polygon, wherein each of the outer face panels is rotatable along a rotation axis normal to the respective outer face panels, and the rotation axes of any two adjacent outer face panels are not parallel, and the rotation of any one of the outer face panels is independent of and not altering any path segment defined in any other of the outer face panels or the orientation of any other of the outer face panels; and wherein the path segments on the at least two of the outer face panels of the puzzle are configured such that at least one sequence of rotations of at least one of the at least two of the outer face panels exists that permits the position indicator to travel along a continuous pathway between a preset starting point and a preset finish point along the at least one path segment of the at least two of the plurality of outer face panels.

2. The space puzzle of claim 1, wherein the at least one path segment is defined by a cut-out slit on the outer face panel where the at least one path segment is located.

3. The space puzzle of claim 1, wherein the at least one path segment is defined by elements visually distinct from the remainder of the outer face panel where the at least one path segment is located.

4. The space puzzle of claim 1, further comprising a puzzle core to which the plurality of outer face panels are engaged, the puzzle core comprising a plurality of blocks fitted together.

5. The space puzzle of claim 1, wherein the outer face panels comprise a paramagnetic material or magnetic material.

6. The space puzzle of claim 1, wherein each of the outer face panels has a same number of sides.

7. The space puzzle of claim 1, wherein not all of the outer face panels have the same number of sides.

8. The space puzzle of claim 1, wherein each of the outer face panels includes a digital touchscreen.

9. The space puzzle of claim 1, wherein the at least one path segment is defined by a visual digital marker.

10. A space puzzle, comprising:

a plurality of outer face panels, at least two of the plurality of outer face panels each defining at least one path segment;

wherein each of the outer face panels has a periphery that takes the shape of a convex regular polygon, wherein each of the outer face panels is rotatable along a rotation axis normal to the respective outer face panels, and the rotation axes of any two adjacent outer face panels are not parallel, and the rotation of any one of the outer face panels is independent of and not altering any path segment defined in any other of the outer face panels or the orientation of any other of the outer face panels: and wherein the path segments on the at least two of the outer face panels of the puzzle are configured such that at least one sequence of rotations of at least one of the at least two of the outer face panels exists that permits a position indicator to travel along a continuous pathway between a preset starting point and a preset finish point along the at least one path segment of the at least two of the plurality of outer face panels.

11. The space puzzle of claim 1, wherein the position indicator can only travel along the at least one path segment in each of the at least two outer face panels along a direction parallel to the outer face panels.

12. The space puzzle of claim 1, wherein the at least one path segment defined in at least one of the at least two of the outer face panels extends to one or more sides of the at least one of the at least two of the outer face panels at least at two different points.

* * * * *